US008523473B2

(12) United States Patent
Kim

(10) Patent No.: US 8,523,473 B2
(45) Date of Patent: Sep. 3, 2013

(54) DUAL TYPE COSMETICS CASE

(76) Inventor: Tae Jin Kim, Vienna, VA (US)

( * ) Notice: Subject to any disclaimer, the term of this patent is extended or adjusted under 35 U.S.C. 154(b) by 0 days.

(21) Appl. No.: 12/442,936

(22) PCT Filed: Feb. 27, 2009

(86) PCT No.: PCT/KR2009/000967

§ 371 (c)(1),
(2), (4) Date: Apr. 23, 2009

(87) PCT Pub. No.: WO2009/108016

PCT Pub. Date: Sep. 3, 2009

(65) Prior Publication Data

US 2011/0293352 A1 Dec. 1, 2011

(30) Foreign Application Priority Data

Feb. 28, 2008 (KR) ..... 10-2008-0018237

(51) Int. Cl.
*A46B 11/00* (2006.01)

(52) U.S. Cl.
USPC ..... 401/126; 401/17

(58) Field of Classification Search
USPC ..... 401/17, 18, 126–130; 215/332, 215/321, 329
See application file for complete search history.

(56) References Cited

U.S. PATENT DOCUMENTS

| | | | | |
|---|---|---|---|---|
| 183,890 | A * | 10/1876 | Block | 215/332 |
| 334,865 | A * | 1/1886 | Howell | 215/208 |
| 3,001,531 | A | 9/1961 | Gazdik | |
| 4,600,328 | A * | 7/1986 | Clements | 401/129 |
| 5,620,270 | A * | 4/1997 | Gueret | 401/126 |
| 6,120,202 | A | 9/2000 | Donsky | |
| 6,343,887 | B1 * | 2/2002 | Dumler et al. | 401/129 |
| 7,997,820 | B2 * | 8/2011 | Bouix et al. | 401/35 |
| 2005/0019084 | A1 | 1/2005 | Gueret | |

FOREIGN PATENT DOCUMENTS

| | | | |
|---|---|---|---|
| DE | 3240152 | A1 | 5/1984 |
| EP | 0701785 | A1 | 3/1996 |
| JP | 2007-020793 | A | 2/2007 |

OTHER PUBLICATIONS

European Search Report for European patent application No. 09700013.7 which corresponds to U.S. Appl. No. 12/442,936.

* cited by examiner

*Primary Examiner* — David Walczak
(74) *Attorney, Agent, or Firm* — LRK Patent Law Firm

(57) ABSTRACT

A dual type cosmetics case includes a plurality of liquid containing parts and inlets partitioned from each other by a vertical partition wall. A plurality of stems immersed into the respective liquid containing parts are mounted in such a way as to be detachably coupled to the liquid containing parts. Each stem is selectively coupled to a cap and then used. The dual type cosmetics case is advantageous in that different kinds or colors of cosmetic liquids are held in one case, so that a user need not carry or keep several different cosmetics, and thus, especially while traveling, the volume of items which are to be carried by a person can be reduced. Further, costs for purchasing cosmetics can be reduced, so that the cosmetics case is very economical.

26 Claims, 12 Drawing Sheets

DUAL TYPE COSMETICS CASE

TECHNICAL FIELD

The present invention relates, in general, to a dual type cosmetics case and, more particularly, to a cosmetics case which is constructed to selectively use different kinds of cosmetic liquids or applicators.

BACKGROUND ART

Generally, when a user applies makeup by dipping a brush into a liquid cosmetic, such as rouge, lip gloss, mascara, cylinder, or nail polish, a cosmetics case, having a cap which is provided on the lower portion of a stem in which bristles are implanted, and a container which is coupled with the cap in a threaded manner, is used. When the cap is fastened to the container so that the stem and the bristles are held in the container, the cosmetics case can be conveniently carried. At the same time, when the cap is separated from the container, the user can apply makeup using the brush covered with the cosmetic liquid.

When using the cosmetics, two or more cosmetics are sequentially applied depending on the method used for applying the makeup. In the case of applying makeup to the eyes, usually, mascara is applied to the eyes, and subsequently eyeliner is applied thereto. Meanwhile, in the case of applying makeup to the lips, usually, rouge for the lips is applied to the lips, and subsequently a coating liquid is applied to the lips. In the case of manicuring the nails, usually, nail polish is applied to the nails, and subsequently a coating liquid is applied to the nails. Thus, for the above-mentioned makeup methods, traditionally, many cosmetics cases must be separately purchased and maintained. The many cosmetics cases require a large storage space, and in addition, the space where the cases are stored becomes messy. Moreover, the purchase of many cosmetics incurs great expense.

Further, it is very complicated and difficult for a person who is beginning to learn how to apply makeup to choose or purchase cosmetics or a makeup set which are suitable for the desired type of makeup. Thus, the person may avoid applying makeup or may omit several steps while applying makeup.

In order to solve the problem, a lip makeup case has been proposed, which is constructed such that liquid rouge and lip gloss are injected, respectively, into two containers, and two stems are coupled, respectively, to the upper and lower portions of a metal grip cylinder, and the containers are fastened, respectively, to caps provided on the upper and lower portions of the grip cylinder in a threaded manner.

Such a conventional case is advantageous in that two kinds of cosmetics are packaged in a single product, thus improving utility. However, the conventional case is problematic in that it is actually inconvenient to use.

When a user applies makeup to the lips using the rouge or lip gloss, any one of the containers is always located above the grip cylinder. Thus, it is inconvenient for the user to apply makeup while holding the grip cylinder in the user's hand.

Further, while the grip cylinder is separated from a selected container, the container, which is located above the grip cylinder, may be opened by mistake, and the cosmetic liquid may leak out of the container.

When the cosmetics are not in use and are in storage at other times, it is difficult to stand the cosmetics case upright, so that the cosmetics case is laid down. In this case, after a predetermined amount of cosmetic liquid is used, each stem is not completely immersed in the corresponding cosmetic liquid, so that it is difficult to dip the stem into the cosmetic liquid.

DISCLOSURE

Technical Problem

Accordingly, the present invention has been made keeping in mind the above problems occurring in the prior art, and an object of the present invention is to provide a dual type cosmetics case which is constructed so that various kinds or colors of cosmetic liquids are contained in one container to be simultaneously used, and which is always maintained upright, and which allows stems immersed in two kinds of cosmetic liquids to be selectively used using one cap.

Technical Solution

In order to accomplish the above object, the present invention provides a dual type cosmetics case, including a container 110 having a liquid containing part 115 and an inlet 113; a plurality of stems 130 inserted into the inlet 113 of the container; a cap 120 coupled to the inlet 113 of the container; and a holder 140 for coupling one of the stems 130 to the cap 120.

The liquid containing part 115 of the container may have one storage space for containing one kind of cosmetic liquid, and may be partitioned into a plurality of sections by a partition wall 111, the partition wall being vertically provided between the plurality of stems 130.

The container 110 comprises a plurality of container parts coupled to each other at positions corresponding to the plurality of stems 130. The container parts are made of different materials and have different colors and degrees of transparency.

The container 110 has a curved shape including that of a circle and an ellipse, or a polygonal shape including that of a rectangle, a diamond, a pentagon and a hexagon.

Further, the container 110 is constructed so that the liquid containing part 115 and a neck 114 defining the inlet 113 comprise different materials, colors and degrees of transparency.

The container 110 or cap 120 is formed to have an external appearance to which a plurality of materials, colors and degrees of transparency are compositely applied through double injection molding.

Further, the container 110 includes a wiper 151 which is provided in the inlet 113 to contact the outer surface of each of the stems 130 and wipes a cosmetic liquid off a surface of the stem 130 when it moves.

The container 110 includes a stem guide hole 153 which is formed through the inlet 113 in the extending direction of each of the stems 130 and guides the movement of the stem 130.

Each of the stems 130 includes an O-ring 155 provided on the outer circumference of the stem 130 in such a way as to be in close contact with the inner circumference of the wiper 151 or the stem guide hole 153.

Each of the stems 130 includes a scraper (not shown) protruding radially from the outer circumference of the stem 130 in such a way as to be in close contact with an inner circumference of the wiper 151 or the stem guide hole 153.

The cap 120 includes a stem positioning part 127 which is provided in the cap 120 in such a way as to protrude to a position corresponding to an inside end of each of the stems 130 and prevents the stem 130 from being pushed into the cap 120 by pressing force.

The plurality of stems 130 have different materials, colors, and shapes.

The holder 140 is provided in the cap 120 and is coupled to one of the plurality of stems 130 outside the container 110 by rotating the cap 120.

Further, the holder 140 includes a plurality of clips 141 opened to be fastened to outer circumferences of the stems 130 provided on first and second sides, by pressing force for rotating the cap 120 forwards and backwards.

The dual type cosmetics case further includes a guide part and a guide moving part. The guide part 161 provides a guide course, and includes a plurality of vertical extension parts 161*a* which are provided on either of an outer surface of the neck 114 of the container and an inner surface of the cap 120 and extend in the moving direction of the cap 120 for detachably fastening the cap to the container, at a position where each of the stems 130 and the holder 140 are coupled, and a horizontal extension part 161*b* for coupling the plurality of vertical extension parts 161*a* to each other. The guide moving part 163 is provided on a remaining one of the outer surface of the neck 114 of the container and the inner surface of the cap 120, and moves along the course guided by the vertical extension parts 161*a* and the horizontal extension part 161*b* of the guide part as the cap 120 is manipulated and rotated to be detachably fastened to the container.

The guide part 161 provides a guide course having a shape of "⊔" or "⊔⊔".

The guide part 161 is depressed, and the guide moving part 163 protrudes to be inserted into the vertical extension parts 161*a* and the horizontal extension part 161*b* of the guide part.

Further, in order to accomplish the above object, the present invention provides a dual type cosmetics case, including a container having first and second containing parts and first and second inlets divided in a vertical direction: a cap coupled to the first and second inlets of the container: first and second stems detachably coupled to the first and second containing parts of the container, respectively; and a holder provided in the cap and coupled to any one of the first and second stems to be taken out of the container.

The container includes a wiper in each of the first and second inlets, for wiping the outer circumference of each of the first and second stems.

The cap has a double structure having an outer cap and an inner cap, an opening prevention uneven part is provided in the lower end of the inner circumference of the inner cap, and a holder is provided at a predetermined position on the upper end of the inner circumference of the inner cap.

The first and second stems include application parts and coupling parts, the application parts being provided on ends of the stems immersed into the first and second containing parts of the container to apply cosmetic liquids, the coupling parts being provided on upper ends of the first and second stems which protrude upwards from the first and second inlets to be detachably coupled to the holder.

Further, the holder includes first and second clips, the first and second clips being provided on left and right sides of an end extending from the upper end of the inner circumference of the inner cap to a center thereof and being coupled to any one of the first and second stems.

Advantageous Effects

A dual type cosmetics case according to the present invention is advantageous in that different kinds of cosmetic liquids or stems are applied to one container, so that a user need not carry around or have in his or her possession several different cosmetics. Thus, especially while traveling, the volume of items which are to be carried by a person can be reduced. Further, costs for purchasing cosmetics can be reduced, so that the cosmetics case is very economical. According to the present invention, a cap separated from a container is used as the handle of a stem, so that it is convenient to use. When the cosmetics case is not in use, it is able to be placed stably upright. Since the cosmetics case is constructed so that a cosmetic liquid collects in the bottom of the container, the application part of the stem is always immersed in the cosmetic liquid. Thereby, the time required for applying makeup is short, and the remaining amount of cosmetic liquid can be minimized. Therefore, the cosmetics case of this invention is very economical.

A conventional cosmetics case is constructed so that a cap is detachably coupled to a container by rotating the cap from 540 to 720°. However, according to the present invention, a cap is simply detachably coupled to a container by rotating the cap slightly such that a guide moving part moves from the vertical or horizontal extension part of a guide part to the horizontal or vertical extension part.

An O-ring and a scraper provided on a stem are in close contact wish a stem guide hole and a wiper provided in the inlet of a container, thus preventing the leakage of cosmetic liquid, and contacting and supporting the outer surface of the stem to stably maintain an installed state. When the stem is moved into the container after the cosmetics case has been used, the cosmetic liquid covered on the inner surfaces of the stem guide hole and the wiper can be wiped clean while being pushed into a liquid containing part.

Figure 1:
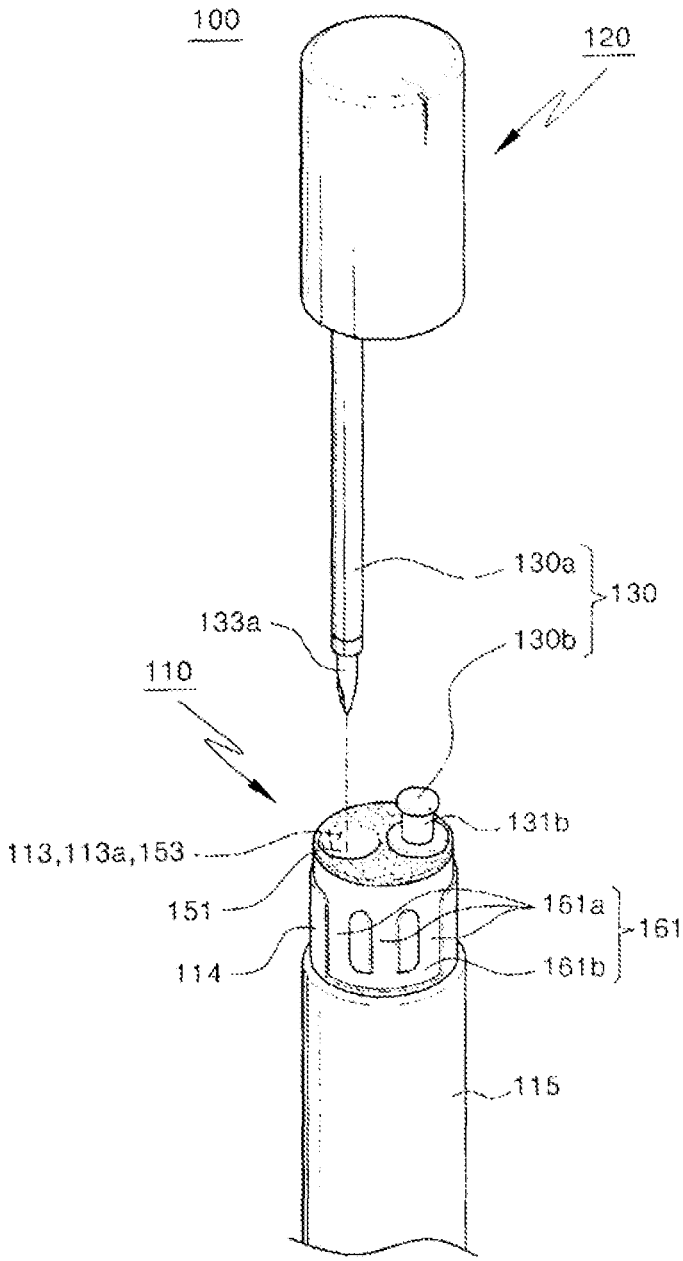
FIG. 1 is an exploded perspective view illustrating the important parts of a dual type cosmetics case according to the first embodiment of the present invention.

<Description of reference characters of important parts>

| | |
|---|---|
| 100: cosmetics case | 110: container |
| 111: partition wall | 113: inlet |
| 113a: first inlet | 113b: second inlet |
| 114: neck | 115: liquid containing part |
| 115a: first containing part | |
| 115b: second containing part | |
| 117: opening prevention uneven part | 120: cap |
| 121: outer cap | 123: inner cap |
| 125: opening prevention uneven part | |
| 127: stem positioning part | |
| 130: stem | 130a: first stem |
| 131a: coupling part of first stem | |
| 133a: application part of first stem | |
| 130b: second stem | 131b: coupling part of second stem |
| 133b: application part of second stem | 140: holder |
| 141: clip | 141a: first clip |
| 141b: second clip | 151: wiper |
| 153: stein guide hole | 155: O-ring |
| 161: guide part | 161a: vertical extension part |
| 161b: horizontal extension part | 163: guide moving part |

BEST MODE

Hereinafter, the preferred embodiments of the present invention will described in detail with reference to the accompanying drawings.

Figure 2:
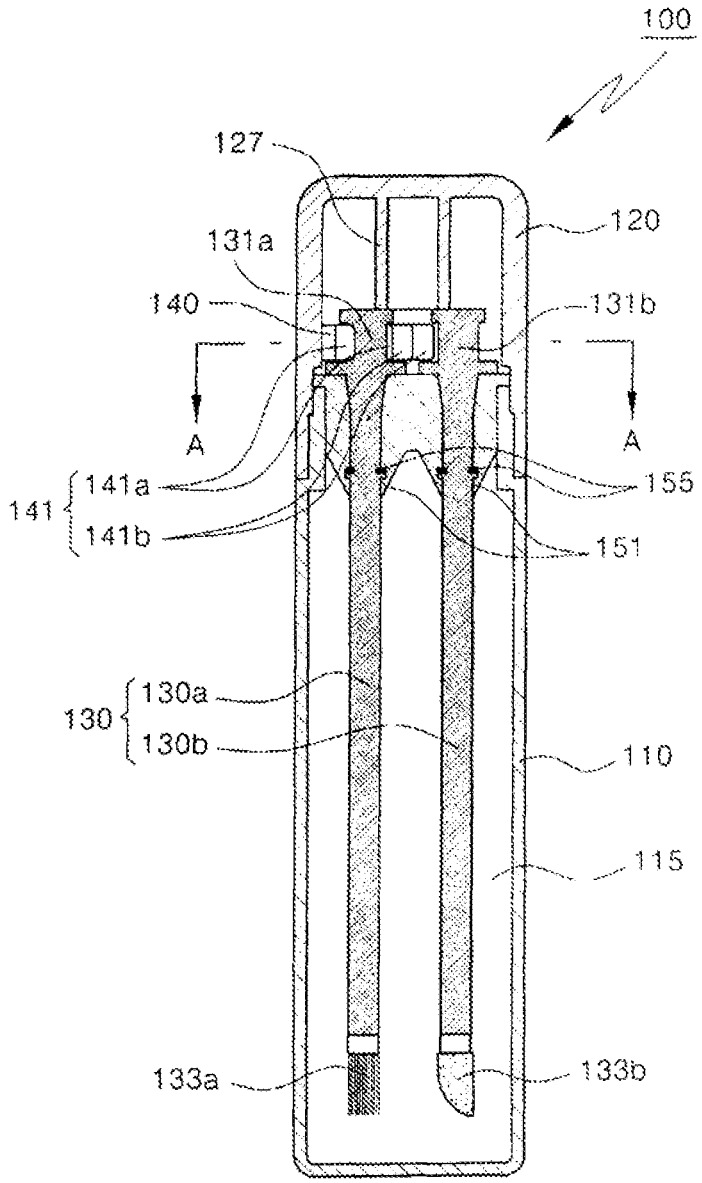
FIG. 2 is a vertical sectional view illustrating a container and stems according to the first embodiment.
Figure 3:
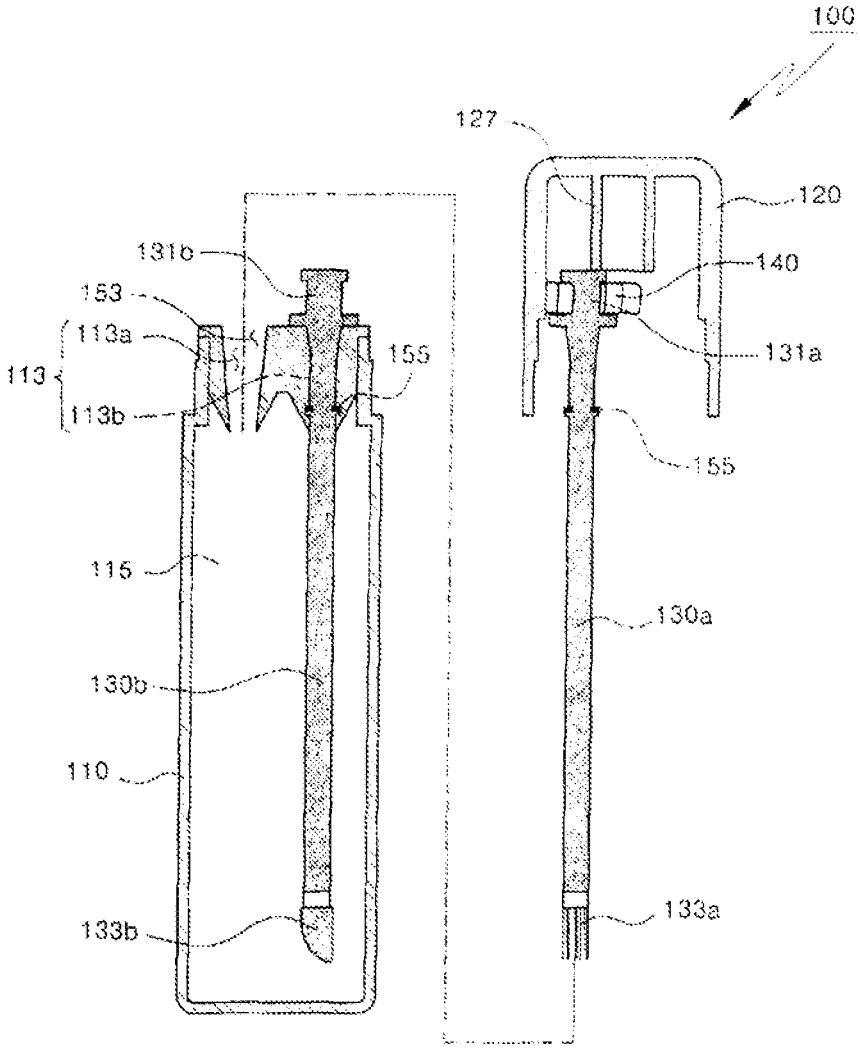
FIG. 3 is an exploded perspective view illustrating the use of the important parts of FIG. 2.
Figure 4:
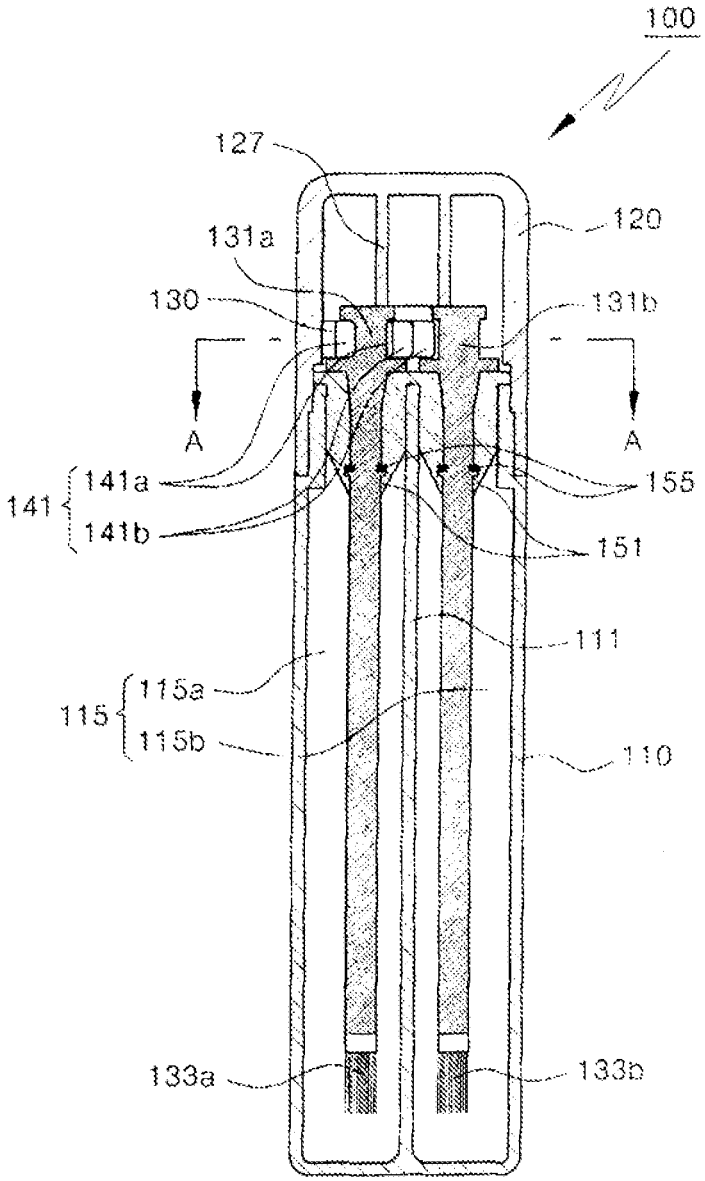
FIG. 4 is a vertical sectional view illustrating a container and stems according to the second embodiment.
Figure 5:
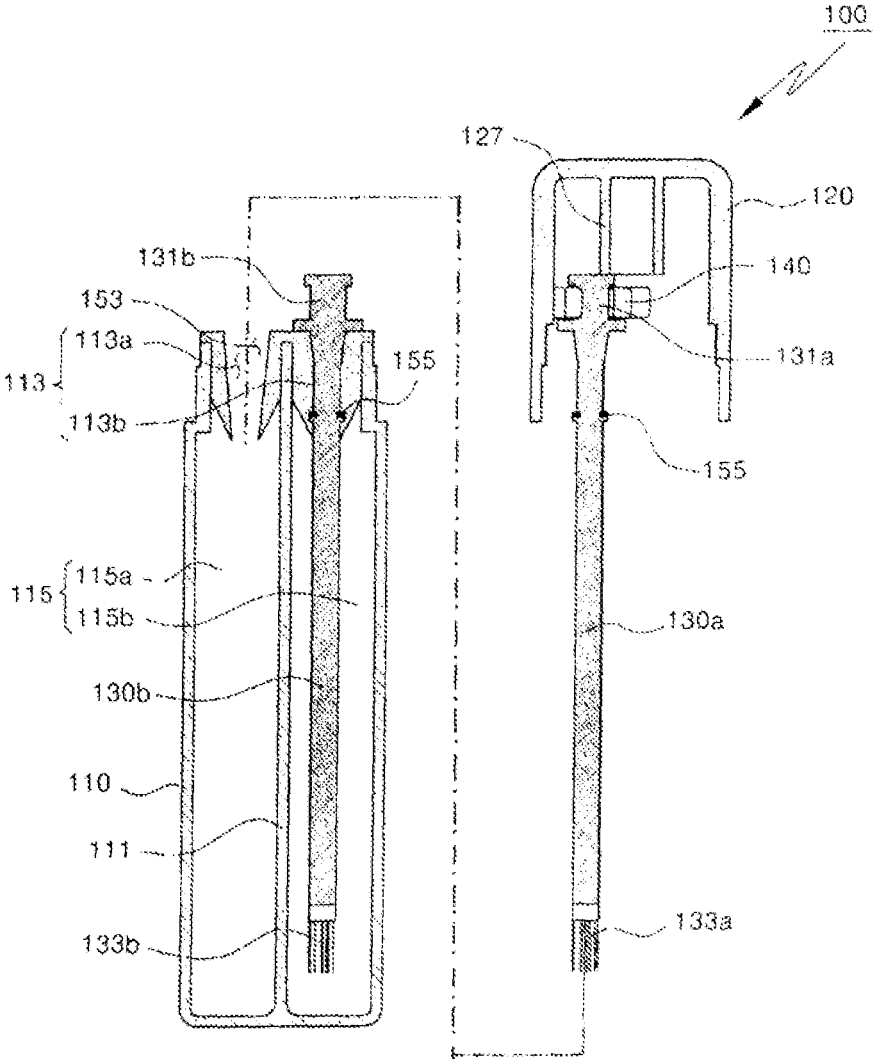
FIG. 5 is an exploded perspective view illustrating the use of the important parts of FIG. 4.
Figure 6:
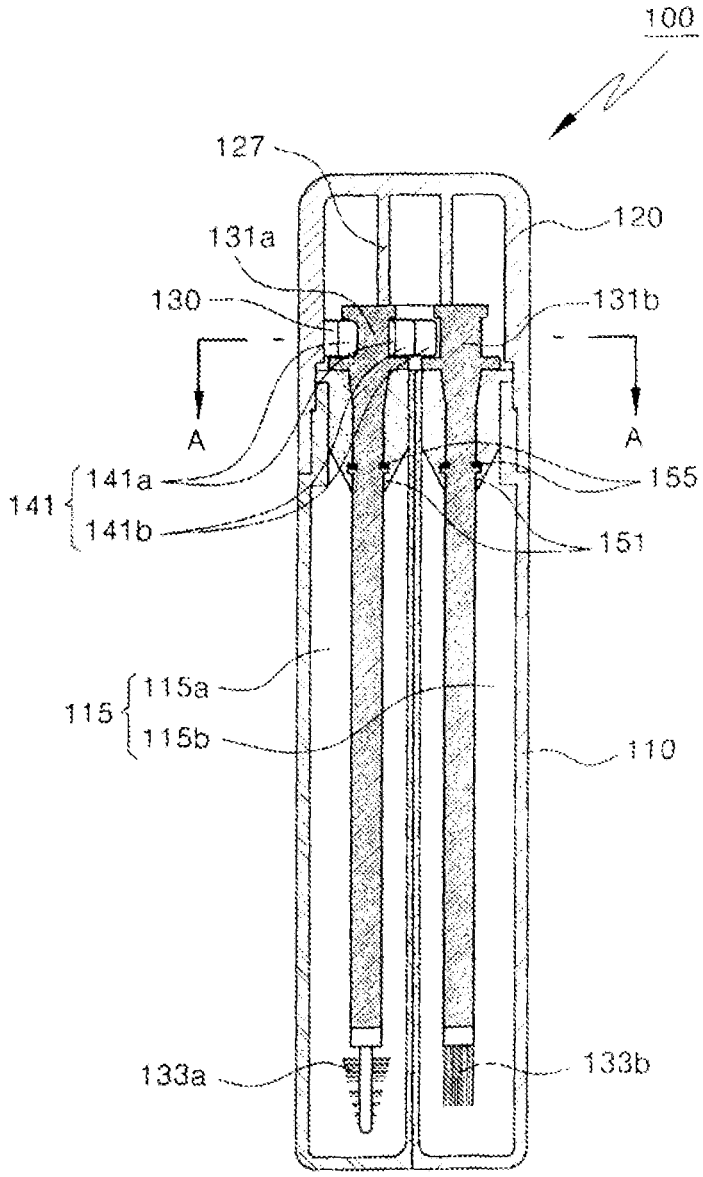
FIG. 6 is a vertical sectional view illustrating a container and stems according to the third embodiment.
Figure 7:
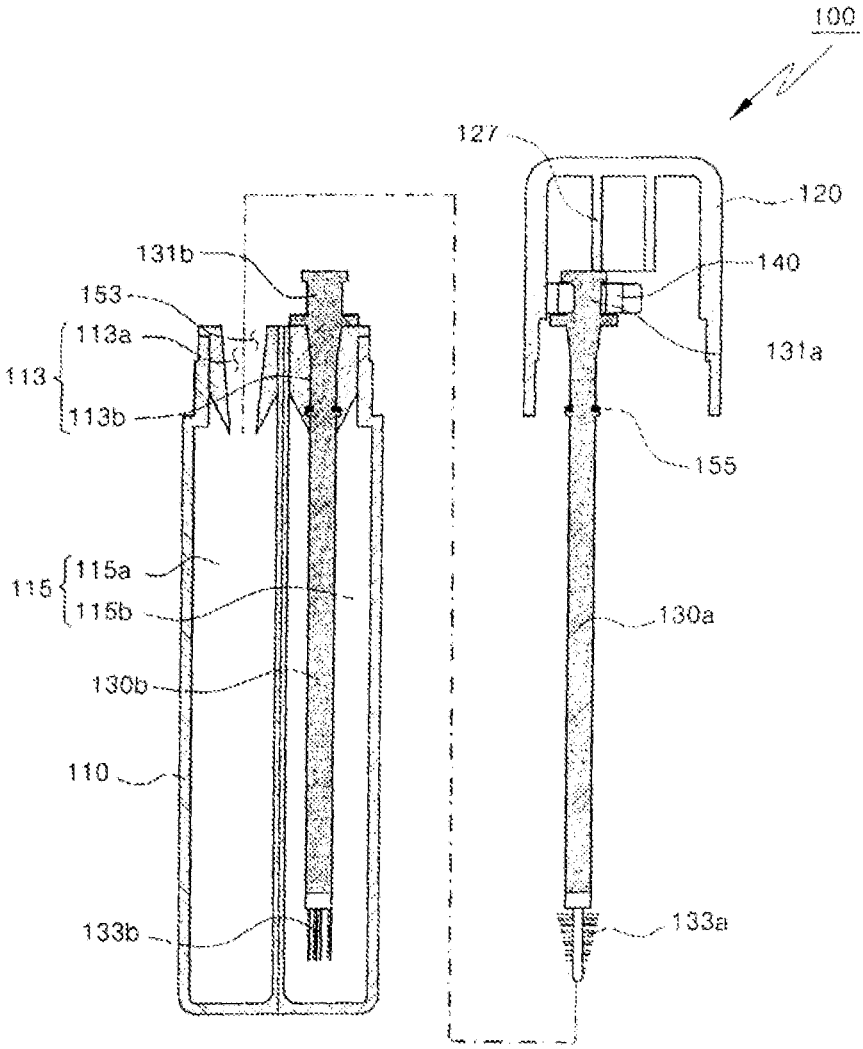
FIG. 7 is an exploded perspective view illustrating the use of the important parts of FIG. 6.
Figure 8:
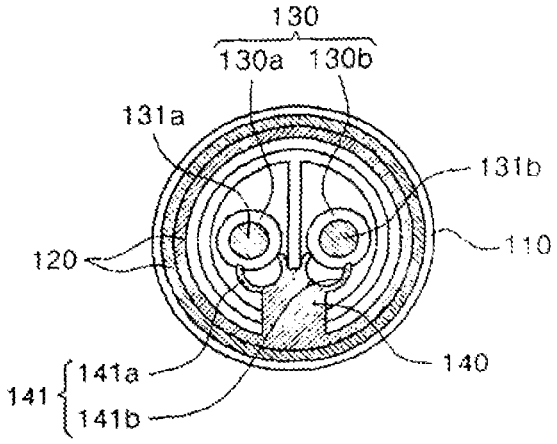
FIG. 8 is a transverse sectional view illustrating the state in which a cup is rotated to be coupled to a container.
Figure 9:
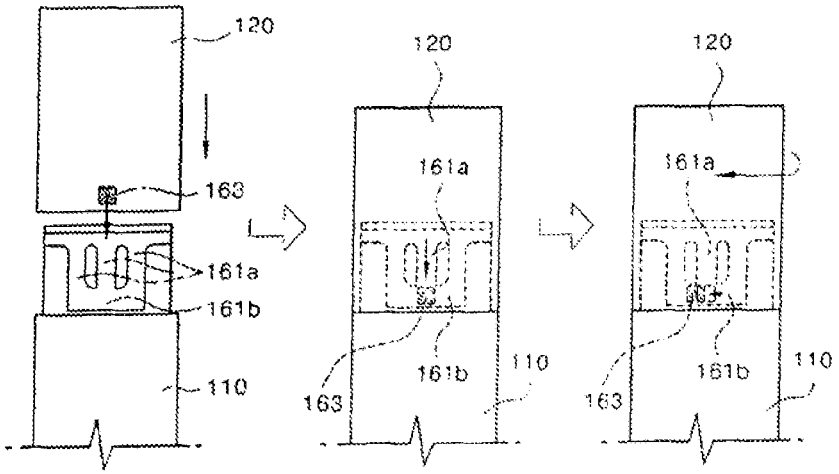
FIG. 9 is a front view showing a guide part and a guide moving part to illustrate the example of assembly wherein the cap and the container of FIG. 8 are coupled to each other.
Figure 10:
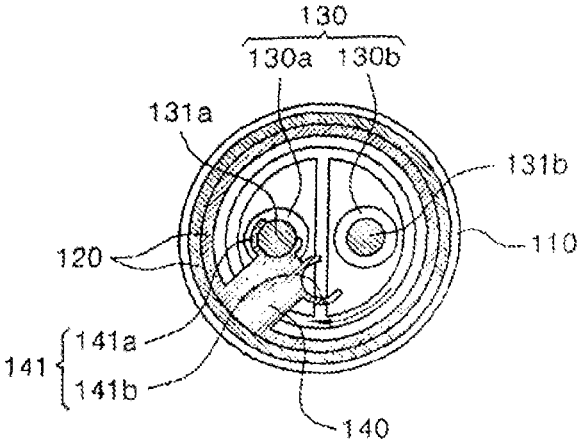
FIG. 10 is a transverse sectional view illustrating the state in which the cap is rotated to couple a stem and a holder to each other.
Figure 11:
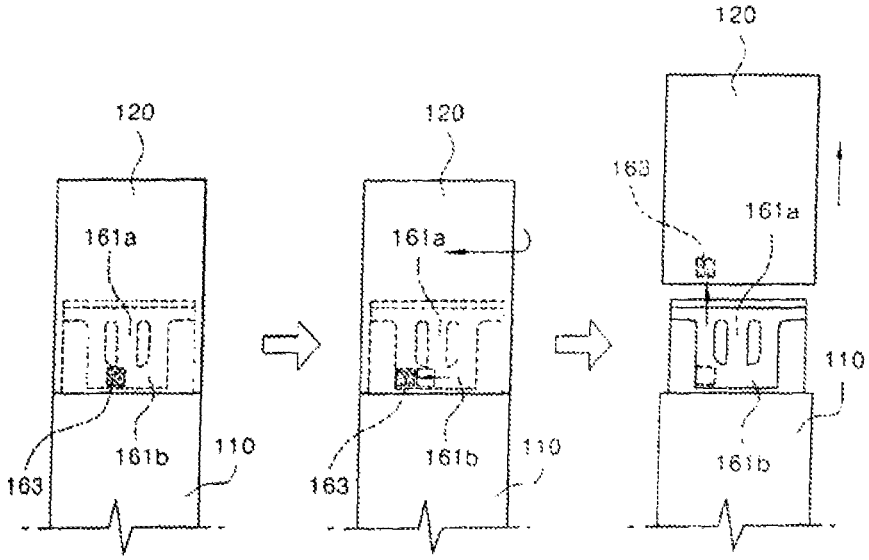
FIG. 11 is a front view showing the guide part and the guide moving part to illustrate the example of the coupled state of the stem with the holder being converted from the state of FIG. 8 to that of FIG. 10.

FIG. 1 is an exploded perspective view illustrating the important parts of a dual type cosmetics case according to the first embodiment of the present invention. FIG. 2 is a vertical sectional view illustrating a container and stems according to the first embodiment. FIG. 3 is an exploded perspective view illustrating the use of the important parts of FIG. 2. FIG. 4 is a vertical sectional view illustrating a container and stems according to the second embodiment. FIG. 5 is an exploded perspective view illustrating the use of the important parts of FIG. 4. FIG. 6 is a vertical sectional view illustrating a container and stems according to the third embodiment, and FIG. 7 is an exploded perspective view illustrating the use of the important parts of FIG. 6. Further, FIG. 8 is a transverse sectional view illustrating the state in which a cap is rotated to be coupled to a container. FIG. 9 is a front view showing a guide part and a guide moving part to illustrate the example of assembly wherein the cap and the container of FIG. 8 are coupled to each other. FIG. 10 is a transverse sectional view illustrating the state in which the cap is rotated to couple a stem and a holder to each other, and FIG. 11 is a front view showing the guide part and the guide moving part to illustrate the example of the coupled state of the stem with the holder being converted from the state of FIG. 8 to that of FIG. 10.

Figure 12:
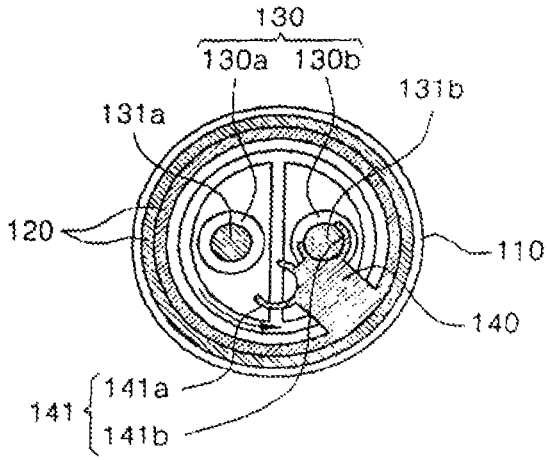
FIG. 12 is a transverse sectional view illustrating the coupled state of the holder with another stem as the cap is rotated.
Figure 13:
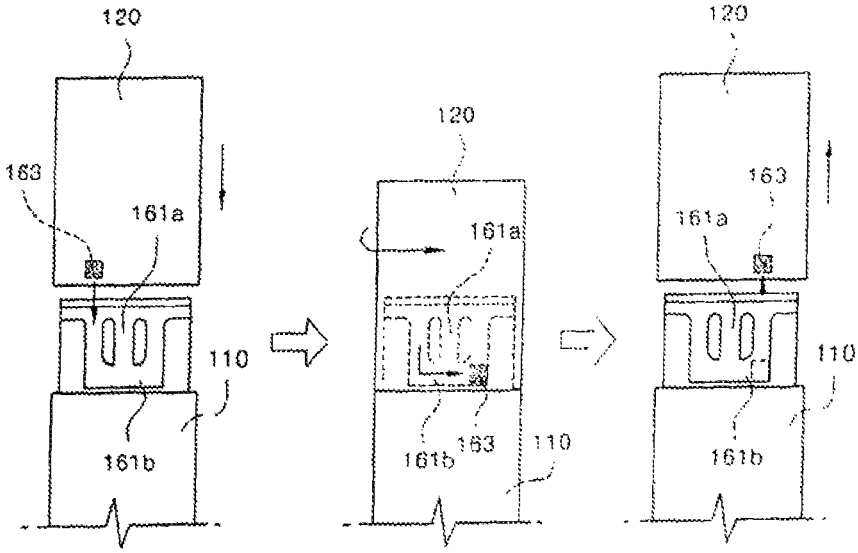
FIG. 13 is a front view showing the guide part and the guide moving part to illustrate the example of the coupled state of the stem with the holder being converted from the state of FIG. 10 to that of FIG. 12.
Figure 14:
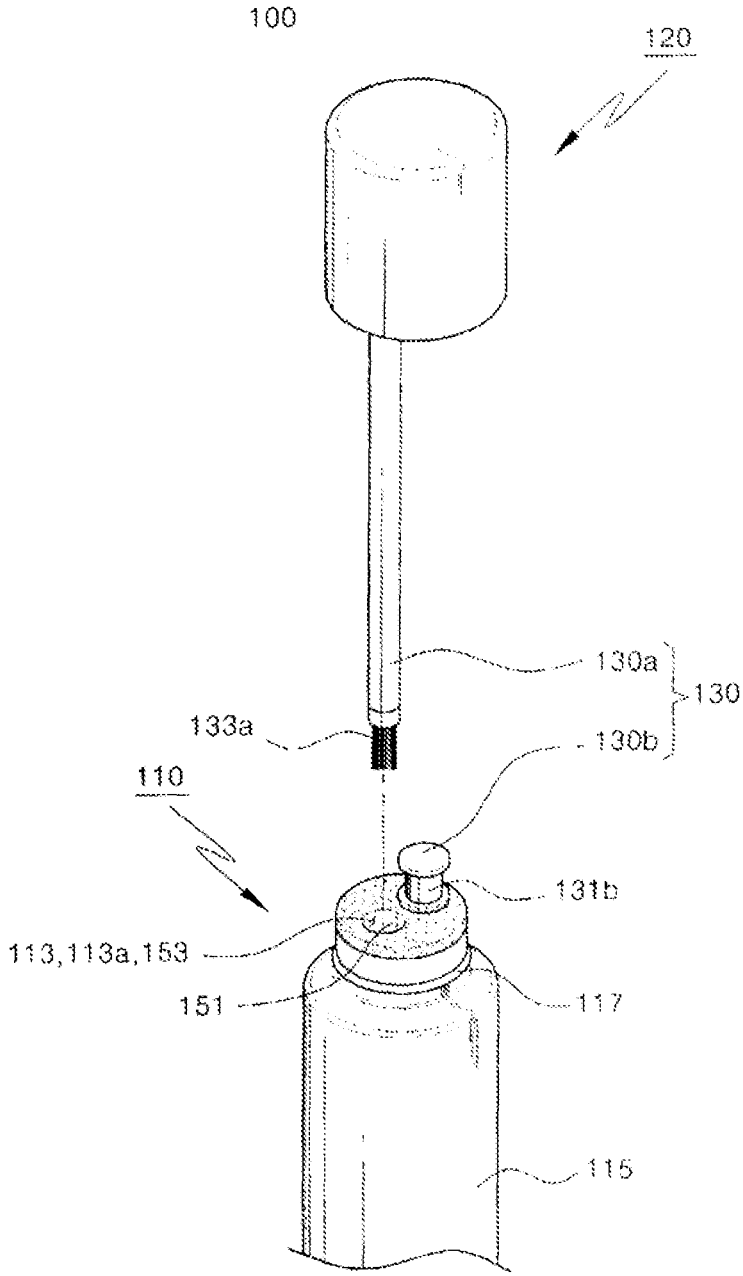
FIG. 14 is an exploded perspective view illustrating a dual type cosmetics case according to another embodiment of the present invention.
Figure 15:
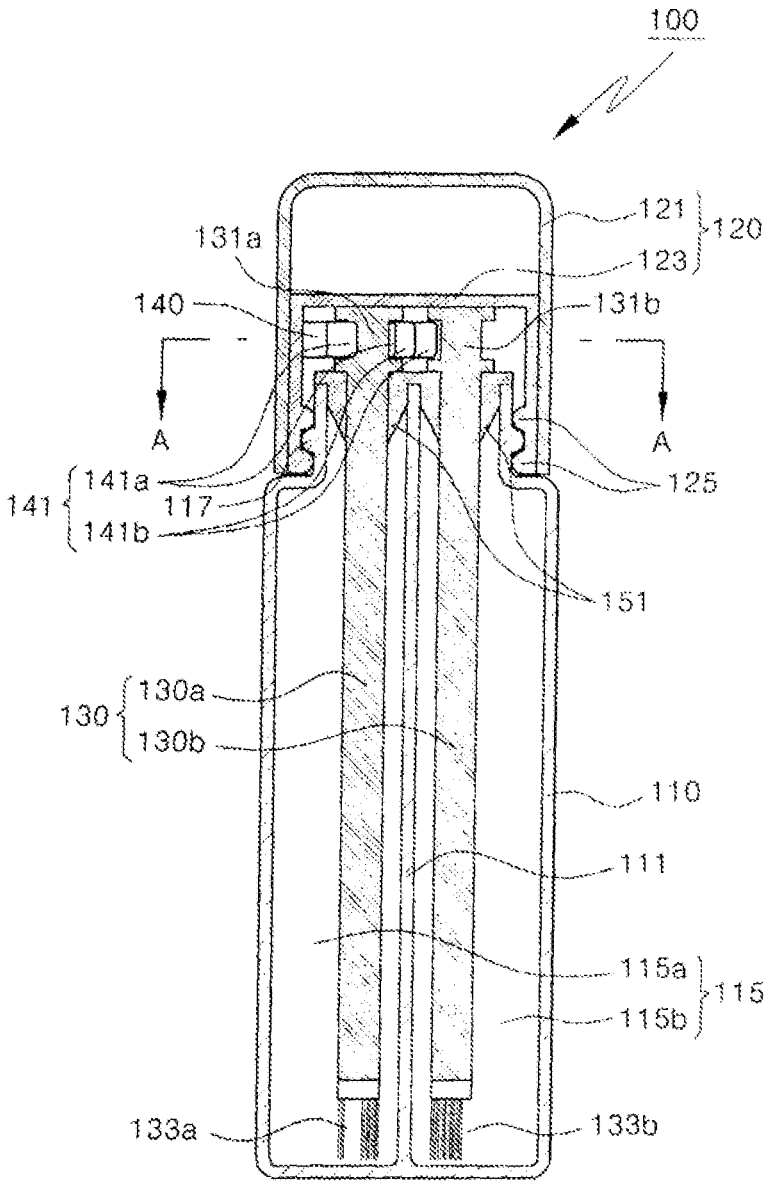
FIG. 15 is a sectional view illustrating the assembled state of the dual type cosmetics case of FIG. 14.
Figure 16:
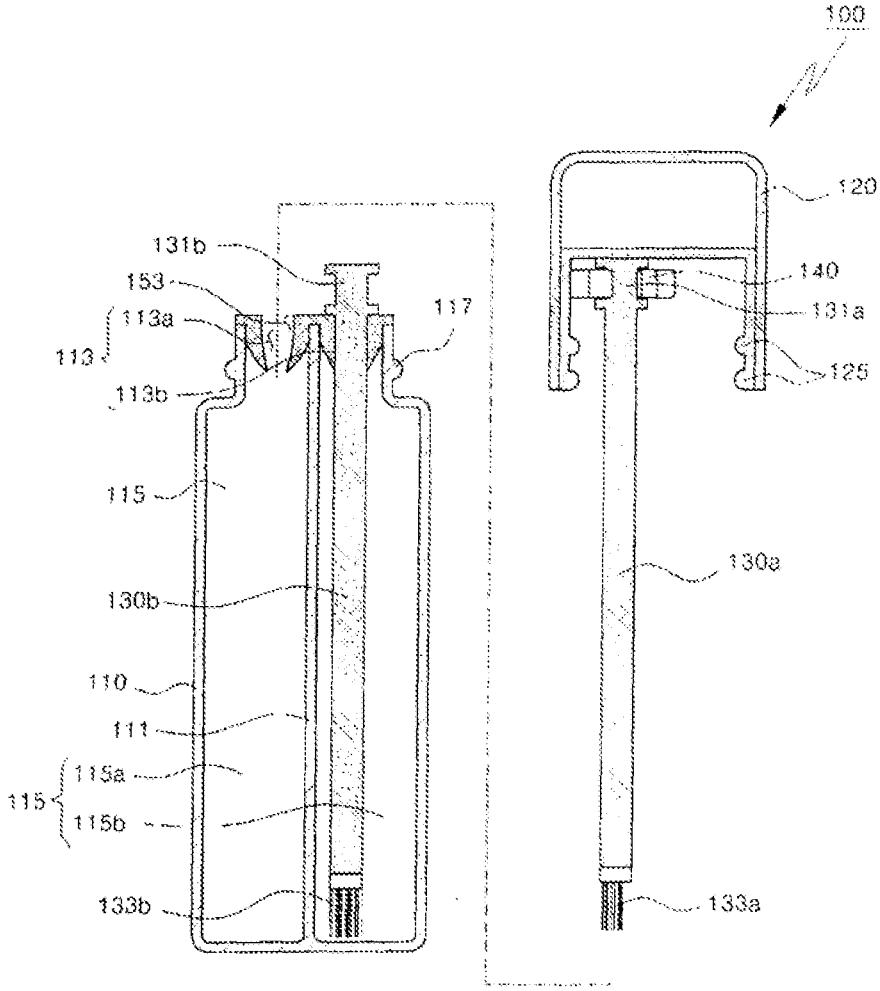
FIG. 16 is an exploded sectional view illustrating the dual type cosmetics case of FIG. 14.

Further, FIG. 12 is a transverse sectional view illustrating the coupled state of the holder with another stem as the cap is rotated. FIG. 13 is a front view showing the guide part and the guide moving part to illustrate the example of the coupled state of the stem with the holder being converted from the state of FIG. 10 to that of FIG. 12. FIG. 14 is an exploded perspective view illustrating a dual type cosmetics case according to another embodiment of the present invention. FIG. 15 is a sectional view illustrating the assembled state of the dual type cosmetics case of FIG. 14, and FIG. 16 is an exploded sectional view illustrating the dual type cosmetics case of FIG. 14. The dual type cosmetics case according to the present invention is a cosmetics case which is constructed to selectively use various cosmetic liquids having different constituents or colors or various applicators having different materials or shapes. The cosmetics case mainly includes a container 110, a plurality of stems 130, a cap 120, and a holder 140.

The container 110 has a liquid containing part 115 and an inlet 113. The plurality of stems 130 which are identical with each other or the plurality of stems 130 which have different materials, colors and shapes pass through the inlet 113 of the container and are installed in such a way as to be parallel to and spaced apart from each other. The cap 120 is coupled to the inlet 113 of the container. The holder 140 couples one of the stems 130 with the cap 120, thus applying a cosmetic liquid using an associated stem 130 coupled to the cap 120.

In a container 110 and stems 130 according to the first embodiment as shown in FIG. 2, the liquid containing part 115 of the container has one storage space which contains one kind of cosmetic liquid. The plurality of stems 130 include a first stem 130*a* having a brush type application part 133*a* which comprises a bundle of bristles, and a second stem 130*b* having an application part 133*b* which comprises a flocking pile.

Thus, when using one kind of cosmetic liquid, as shown in FIG. 3, depending on whether it is suitable for using the brush type application part 133*a* of the first stem or for using the application part 133*b* of the second stem comprising the flocking pile, either of the first stem 130*a* or the second stem 130*b* is selected using the holder 140 and then coupled to the cap 120. In this state, it is possible to apply the cosmetic liquid.

In a container 110 and stems 130 according to the second embodiment as shown in FIG. 4, the liquid containing part 115 of the container is partitioned into a first containing part 115*a* and a second containing part 115*b* by a partition wall 111 which is vertically provided between the plurality of stems 130. The plurality of stems 130 comprise a first stem 130*a* and a second stem 130*b* which are made of the same material and have the same color or shape.

Therefore, various kinds of cosmetic liquids having different constituents or colors can be contained together in the liquid containing part 115 of the container. When the first stem 130*a* and the second stem 130*b* having the same characteristic quality, color and shape are used, as shown in FIG. 5, a cosmetic liquid in which each of the first stem 130*a* and the second stem 130*b* is immersed may be selectively applied.

Lip gloss is usually oily and low in volatility. Further, even though the lip gloss flows down along the inner wall of the case, it does not adhere well thereto and does not remain on the inner wall, thus keeping the inner wall of the case clean. Thus, the case for lip gloss is made of a transparent plastic material so that a user can easily check the used amount of the lip gloss. However, mascara liquid contains a volatile solvent therein, so that a mascara case is generally manufactured using polypropylene (PP) or poly vinyl chloride (PVC) so as to prevent to the highest degree possible the solidification of the mascara liquid resulting from the volatilization thereof. Further, the mascara liquid mainly has a deep color such as black and frequently adheres to the inner wall of the mascara case. Thus, the mascara liquid is manufactured to be opaque, so that it is impossible to see the adhesion or remaining amount of the mascara liquid from the exterior.

In a container 110 and stems 130 according to the third embodiment as shown in FIG. 6, the container 110 is similar to the container 110 of the second embodiment shown in FIG. 4 in that the container contains various kinds of cosmetic liquids. However, unlike the second embodiment, the container includes a first containing part 115*a* and a second containing part 115*b* which are made of different materials, have different colors and degrees of transparency, and are coupled with corresponding stems 130.

When differing kinds of cosmetic liquids are contained in the first containing part 115*a* and the second containing part 115*b*, different materials, colors, and degrees of transparency may be applied to the first containing part 115*a* and the second containing part 115*b* which contain the respective cosmetic liquids. Further, the stems 130 may comprise a first stem 130*a* and a second stem 130*b* which have different shapes to be suitable for applying different kinds of cosmetic liquids.

Thus, as shown in FIG. 7, the first stem 130*a* or the second stem 130*b* is selectively coupled to the cap 120, so that different cosmetic liquids into which the first stem 130*a* and the second stem 130*b* having different shapes are immersed can be used compositely.

When the containers 110 according to various embodiments are manufactured, as long as the partition wall 111 may be manufactured or a plurality of containers may be joined to each other in parallel through double injection molding, insert injection molding or ultrasonic welding, even if the container 110 does not have only one liquid containing part 115, the cosmetics case may have a curved profile such as an ellipse, and polygonal profiles including the shapes of a rectangle, a diamond, a pentagon, and a hexagon, in addition to a circular cross-section and a cylindrical profile generally applied to cosmetics cases.

The liquid containing part 115 of the container and a neck 114 defining the inlet 113 may be manufactured into a single structure through injection molding. However, the cosmetic liquid is apt to adhere to or remain on the neck 114. Thus, when the container 115 is made of a transparent material, preferably, the neck 114 is made of an opaque material or made to have a color deeper than that of the liquid containing part 115 so as to prevent the appearance of the neck 114 of the cosmetics case from being marred due to the adhesion of the cosmetic liquid. When the container 110 is manufactured as such, through double injection molding, ultrasonic welding and printing, the liquid containing part 115 and the neck 114 are integrally coupled to each other, and the liquid containing part 115 and the neck 114 are preferably made of different materials and have different colors and degrees of transparency, in consideration of respective functions and use.

In the manufacture of the container 110, the liquid containing part 115 and the neck 114 are separately manufactured. Further, the liquid containing part 115 or the neck 114 itself may be manufactured through double injection molding after being partitioned into a plurality of sections such that the cosmetics case has an external appearance to which various materials, colors, and degrees of transparency are applied. The cap 120 may be manufactured to be composed of a variety of materials, colors and degrees of transparency.

If a stem guide hole 153 is formed in the extending direction of the stem 130 such that the inner surface of the stem guide hole is spaced apart from the outer surface of the stem 130 but is near thereto, the inward and outward movements of the stem 130 can be stably guided along a predetermined course. If a wiper 151 is provided in the inlet 113 to be in close contact with the outer surface of the stem 130, the cosmetic liquid covered on the outer surface of the stem 130 may be wiped when the stem 130 moves out of the container 110 so as to apply the makeup.

Further, when an O-ring 155 made of a soft or elastic deformable material such as a rubber material is fitted over the outer circumference of the stem 130 in such a way as to be in close contact with the inner surface of the wiper 151 or the stem guide hole 153, or when a scraper (not shown) protrudes radially from the outer circumference of the stem 130 in such a way as to be in close contact with the inner surface of the wiper 151 or the stem guide hole 153, the stem 130 may be in close contact with the stem guide hole 153 or the wiper 151.

The O-ring 155 or the scraper provided on the stem 130 comes into contact with the stem guide hole 153 or the wiper 151, thus preventing the leakage of the cosmetic liquid, and contacts and supports the outer surface of the stem 130, thus reliably maintaining an installed state. When the stem 130 is moved into the container 110 after having applied the makeup, the cosmetic liquid which has adhered onto the inner surface of the stem guide hole 153 or the wiper 151 may be wiped while being pushed into the liquid containing part 115.

When the holder 140 is provided in the cap 120, one end of the stem 130 is also located in the cap 120. If a stem positioning part 127 protrudes at a position corresponding to one end of the stem 130 in the cap 120, the stem 130 is prevented from being pushed and moved into the cap 120 by pressing force while or when the cap 120 is being coupled to or has been coupled to the container 110.

Thus, as shown in FIGS. 2 through 7, all of the stems 130 which are coupled to the holder 140 or removed from the holder 140 are constrained by the stem positioning part 127 such that they are held at predetermined positions where each stem air-tightly contact the stem guide hole 153 or the wiper 151, thus preventing the cosmetic liquid from leaking out of the container 110. Even in the case of applying the makeup using the cap 120, the stem positioning part 127 constrains the movement of each stem 130, thus permitting stable application and use.

The holder 140 is provided on the cap 120 to be selectively coupled to any one of the plurality of stems 130 outside the container 110 by manipulating and rotating the cap 120. As shown in FIGS. 8, 10, and 12, the holder may include a plurality of clips 141. A side of each clip is open to be smaller than the outer diameter of each stem 130, so that the clip is removably fastened to the outer circumference of one of the plurality of stems 130 by the pressing force of rotating the cap 120 forwards or backwards.

As shown in FIGS. 1, 9, 11 and 13, the dual type cosmetics case according to the first embodiment of the present invention is constructed so that a guide part 161 and a guide moving part 163 are provided on the outer surface of the neck 114 of the container and the inner surface of the cap 120, respectively.

The guide part 161 includes a plurality of vertical extension parts 161*a* and a horizontal extension part 161*b*. The vertical extension parts 161*a* are provided at positions where the plurality of stems 130 are coupled to the holder 140, and extend in the direction of moving the cap 120 so as to attach or detach the cap to or from the container. The horizontal extension part 161*b* couples the plurality of vertical extension parts 161*a* with each other. Thereby, a guide course having the shape of "⊔" or "⊔⊔" is formed in intaglio.

The guide moving part 163 protrudes to be inserted into the vertical extension parts 161*a* and the horizontal extension part 161*b* of the guide part, so that the guide moving part moves freely along a course guided by the vertical extension parts 161*a* and the horizontal extension part 161*b* of the guide part by rotating the cap 120 so as to attach or detach the cap to or from the container. In a conventional cosmetics case, a cap and a container have screw-type fastening parts (threaded parts), so that the cap is detachably coupled to the container by rotating the cap from 540 to 720°. However, according to the present invention, the cap 120 is simply attached to or detached from the container 100 by just a slight rotation of the cap such that the guide moving part 163 is moved from the associated vertical extension part 161*a* of the guide part to the horizontal extension part 161*b* or from the horizontal extension part 161*b* to the associated vertical extension part 161*a*.

In the case where the guide part 161 has a "⊔" shape, when the cap 120 is first assembled with the container 110, as shown in FIG. 10 or 12, one of the first and second stems 130*a* and 130*b* is coupled to the holder 140 and the cap 120. In this state, the cap can be easily assembled with the container 110.

In the case where the guide part 161 has a "⊔⊔" shape, when the cap 120 is first assembled with the container 110, one of the first and second stems 130*a* and 130*b* is not coupled to the holder 140 and the cap 120. Thus, as shown in FIG. 8, the holder 140 is spaced apart from the first and second stems 130*a* and 130*b*. In this state, the cap is manipulated as shown in FIG. 9, so that the cap 120 is easily assembled with the container 110.

After the cap 120 is assembled with the container 110 first, the cap 120 is manipulated and rotated forwards as shown in FIG. 11, so that the holder 140 is fastened to the first stem 130*a* as shown in FIG. 10. Thereafter, the cap 120 is removed from the container 110. Through such a process, the cosmetic liquid covered on the first stem 130*a* can be used.

After the first stem 130*a* has been used, an end of the first stem 130*a* passes through the stem guide hole 153 or the wiper 151 into the container 110. After the position and direction of the cap 120 are adjusted such that the guide moving part 163 is located at a vertical extension part 161*a* provided at a position where the first stem 130*a* and the holder 140 are fastened to each other, the cap 120 is pushed to the liquid containing part 115. Further, by rotating the cap 120 at a predetermined angle such that the guide moving part 163 enters the horizontal extension part 161*b*, the cap 120 may be simply assembled with the container 110.

When a user desires to use the second stem 130*b*, as shown in FIG. 13, the cap 120 is manipulated and rotated backwards, so that the holder 140 is fastened to the second stem 130*b*, as shown in FIG. 12. Thereafter, the cap 120 is removed from the container 110, so that the cosmetic liquid attached to the second stem 130*b* can be used.

After the second stem 130*b* has been used, the cap is assembled with the container, in a manner similar to the operation of assembling the cup 120 with the container 110 after the use of the first stem 130*a*. That is, as the cap 120 is moved and rotated so that the guide moving part 163 enters the horizontal extension part 161*b* through the vertical extension part 161*a* which is provided at a position where the second stem 130*b* and the holder 140 are fastened to each other, the cap 120 may be simply assembled with the container 110.

If an identification character or pattern is marked on the cap 120 or the container 110 so that a user can easily see the proper coupling position and direction of the cap 120 for the use of each of the first and second stems 130*a* and 131*b*, he or she can more easily attach or detach the cap 120 to or from the container 110 by manipulating and rotating the cap when the plurality of stems 130 are selectively used.

Further, arrows showing the leftward and rightward rotating directions may be marked on the upper surface of the cap 120, and contents, such as mascara or cylinder, may be marked on the ends of the arrows using characters or pictures. As such, identification characters or pictures are preferably marked on the cap 120 or the container 110 so that a user can easily determine the kind of cosmetic liquid contained in the liquid containing part 115 or the kind of the first or second stem 130*a* or 130*b*. In the case where the cosmetics case contains various kinds of cosmetic liquids, if the container 110 is manufactured to be transparent or clearly divided into several sections of different color, degree of transparency and shape, a user can easily determine the kind of contents therein.

In a dual type cosmetics case according to another embodiment of the present invention shown in FIG. 14, a pair of stems 130*a* and 130*b* is freely attached to or detached from the container 110. After one of the stems 130*a* and 130*b* is coupled to the lower surface of the cap 120 coupled to the container 110, the stem is taken out of the container when the cap 120 is separated from the container 110.

At this time, a cosmetic liquid on the application part 133 of the stem 130 is taken out of the container. In this state, a user can apply makeup using the application part 133.

FIG. 14 illustrates, the embodiment wherein a selected stem 130 is separated from the container 110 together with the cap 120, and a non-selected stem 130 is retained in the container 110. Although not shown in FIG. 14, a holder (not shown) is provided in the cap 120 and selectively coupled to one of the stems 130*a* and 130*b*.

FIG. 15 is a sectional view illustrating the assembled state of the dual type cosmetics case according to the present invention which is shown in FIG. 14, and FIG. 16 is an exploded sectional view illustrating the dual type cosmetics case according to the present invention which is shown in FIG. 14.

As shown in the drawings, the cosmetics case of the present invention includes a container 110, a cap 120, first and second stems 130*a* and 130*b*, and a holder 140. The container includes first and second containing parts 115*a* and 115*b* which are divided from each other in a vertical direction, and first and second inlets 113*a* and 113*b* which are divided from each other in the vertical direction. The cap is coupled to the first and second inlets 113*a* and 113*b* of the container. The first and second stems 130*a* and 130*b* are freely attached to or detached from the first and second containing part 115*a* and 115*b* of the container. The holder 140 is provided in the cap 120 and selectively coupled to either of the first and second stems 130*a* and 130*b* so as to remove the selected stem from the container 110.

The container 110 has the first and second containing parts 115*a* and 115*b* which contain two different kinds of cosmetic liquids. Each of the first and second containing parts 115*a* and 115*b* has an inlet. That is, the first containing part has the first inlet 113*a* and the second containing part has the second inlet 113*b*.

The first and second containing parts 115*a* and 115*b* contain different kinds of cosmetic liquids (e.g., mascara and cylinder, rouge and lip gloss, etc.), and are partitioned off from each other by a partition wall 111 which is vertically provided in the container 110. Of course, the first and second containing parts 115*a* and 115*b* may contain cosmetic liquids which are of the same kind but differ from each other in color.

Here, the partition wall 111 partitions the interior of the container 110 into a plurality of independent spaces. If necessary, the interior of the container may be partitioned into two or more spaces. Preferably, such a partition wall 111 is integrally formed while the container 110 is formed.

Further, the container 110 may be manufactured using glass or synthetic resin. Preferably, the container is made of a transparent or semi-transparent material so that cosmetic liquids stored in the container can be seen therethrough.

Wipers 151 are coupled to the first and second inlets 113*a* and 113*b* of the container. The wipers 151 compress the outer circumferences of the first and second stems 130*a* and 130*b* which are manufactured using a soft rubber material having elasticity and pass through the first and second inlets 113*a* and 113*b*, and the outer circumferences of application parts 133*a* and 133*b*, thus appropriately wiping cosmetic liquids from the outer circumferences of the first and second stems 130*a* and 130*b* and the outer circumferences of the application parts 133*a* and 133*b*, therefore preventing excessive amounts of cosmetic liquids from getting onto and flowing down the stems.

An opening prevention uneven part 117 is provided on the outer circumferences of the first and second inlets 113*a* and 113*b* of the container. The opening prevention uneven part 117 is an annular protrusion, and functions to prevent the removal of the cap 120 when the cap is coupled to the container.

The wipers 151 provided in the first and second inlets 113*a* and 113*b* may be separately manufactured, but a pair of wipers may be integrally formed as shown in FIGS. 1 to 3. Each wiper 151 functions to support the first or second stem 130*a* or 130*b* provided in the container 110 so as to prevent the shaking or removal of the first or second stem, in addition to wiping the cosmetic liquid.

The cap 120 has a double structure including an outer cap 121 and an inner cap 123. This provides a good external appearance to the cosmetics case.

That is, the inner cap 123 has in the lower end thereof an opening prevention uneven part 125. The holder 140 is provided at a predetermined position in the upper end of the inner case to be coupled to the first and second stems 130*a* and 130*b*. As such, the inner cap provides a mechanical function. In contrast, the outer cap 121 is coupled to the outer portion of the inner cap 123, thus providing a good appearance to the cap 120.

The outer cap 121 is manufactured using a metal material, thus contributing to an improvement in the quality of a product manufactured therewith.

Here, the opening prevention uneven part 125 provided in the inner cap 123 is an annular protrusion, and engages with the opening prevention uneven part 117 provided on the container 110, thus preventing the cap 120 from being easily removed from the container 110.

Further, the holder 140 includes first and second clips 141*a* and 141*b* which branch leftwards and rightwards from an end extending from the inner circumference of the upper end of the inner cap 123 to the center thereof.

Here, each of the first and second clips 141*a* and 141*b* may be manufactured in a "C" shape. Such a shape advantageously surrounds the outer circumference of the first or second stem 130*a* or 130*b*. The holder is detachably coupled to the first or second stem 130*a* or 130*b* using the open portion of each "C"-shaped clip. The opening must be smaller than the diameter of each of the first and second stems 130*a* and 130*b*.

Owing to such a construction, the first or second stem 130*a* or 130*b* is not easily separated from the first or second clip 141*a* or 141*b* and is separated only by proper external force.

Thus, each of the first and second clips 141*a* and 141*b* preferably has a predetermined elastic restoring force. To this end, the holder 140 is made of an elastic material, or the thickness of the opening side of the first or second clip 141*a* or 141*b* is manufactured to be thin, so that it is deformed when the holder is detachably coupled to the associated stem.

The holder 140 may be integrated with the inner cap 123 into a single structure. However, if the holder and the inner cap are manufactured using different materials (e.g., metal material), they may be assembled with each other.

The first and second stems 130*a* and 130*b* have application parts 133*a* and 133*b*, respectively. Each application part is provided on the lower end of the first or second stem which is immersed into the first or second containing part 115*a* or 115*b* of the container, and is used to apply the cosmetic liquid. Coupling parts 131*a* and 131*b* are provided on the upper ends of the first and second stems which protrude upwards from the first and second inlets 113*a* and 113*b*, and are detachable coupled to the holder 140.

Each of the application parts 133*a* and 133*b* is the means for applying a cosmetic liquid, and may be manufactured in the form of a brush. In addition to the brush form, each application part may have the form of a comb brush or a sponge.

Further, each of the coupling parts 131*a* and 131*b* preferably has an "I" shape. Horizontally extending stoppers are provided on the upper and lower ends of each of the coupling parts 131*a* and 131*b*, thus preventing the first or second clip 141*a* or 141*b* of the holder 140 coupled to a side of an associated coupling part from being removed from the coupling part in a vertical direction.

The first and second stems 130*a* and 130*b* are normally kept inside the container 110 in the state of being immersed in the cosmetic liquids of the container. However, when a user desires to apply makeup, one of the stems is selected by the user, so that the stems are alternately used. When the cap 120 is rotated leftwards or rightwards as desired, the first and second clips 141*a* and 141*b* of the holder 140 are repetitively coupled to or separated from the first and second stems 130*a* and 130*b*. Thereby, if one of the stems is selected, the cap 120 is pulled in a vertical direction so as to be separated from the container 110. At this time, the opening prevention uneven parts 125 and 117 engage with each other between the cap 120 and the container 110. Thus, the cap 120 is subjected to force to be separated from the container. At this time, it is preferable, that the cap be bent slightly when separated from the container. After a user finishes applying makeup using the first stem 130*a* which is first taken out from the container 110, as shown in FIG. 4, the cap 120 is coupled to the container 110 again and rotated clockwise. While the first stem 130*a* is separated from the first clip 141 of the holder 140, the second clip 143 is coupled to the second stem 130.

When the second stem 130 has been selected as such, the cap 120 is separated from the container 110, so that a user applies makeup using the selected second stem 130.

In this way, a user can easily apply makeup while alternately using two different kinds of cosmetic liquids. Further, according to the present invention, cosmetic liquids contained in the container 110 are set to meet a consumer's requirement when a product comes onto the market, thus saving the trouble of selecting cosmetics.

The invention claimed is:

1. A dual type cosmetics case comprising:

a container having a liquid containing part and an inlet;

a plurality of stems detachably coupled to the inlet of the container;

a cap coupled to the inlet of the container; and a holder that couples selectively one of the stems to the cap one at a time provided in the cap.

2. The dual type cosmetics case according to claim 1, wherein the liquid containing part of the container comprises one storage space that contains one kind of cosmetic liquid.

3. The dual type cosmetics case according to claim 1, wherein the liquid containing part of the container is partitioned into a plurality of sections by a partition wall, the partition wall being vertically provided between the plurality of stems.

4. The dual type cosmetics case according to claim 1, wherein the container comprises a plurality of container parts coupled to each other at positions corresponding to the plurality of stems, the container parts being made of different materials and having different colors and degrees of transparency.

5. The dual type cosmetics case according to claim 4, wherein the container has a curved shape including that of a circle and an ellipse, or a polygonal shape including that of a rectangle, a diamond, a pentagon and a hexagon.

6. The dual type cosmetics case according to claim 1, wherein the container has a curved shape including that of a circle and an ellipse, or a polygonal shape including that of a rectangle, a diamond, a pentagon and a hexagon.

7. The dual type cosmetics case according to claim 1, wherein the container is constructed so that the liquid containing part and a neck defining the inlet comprise different materials, colors and degrees of transparency.

8. The dual type cosmetics case according to claim 1, wherein the container or cap is formed to have an external appearance to which a plurality of materials, colors and degrees of transparency are compositely applied through double injection molding.

9. The dual type cosmetics case according to claim 1, wherein the container comprises:

a wiper provided in the inlet to contact an outer surface of each of the stems, and wiping a cosmetic liquid off a surface of the stem when the stem moves.

10. The dual type cosmetics case according to claim 9, wherein each of the stems comprises:

an O-ring provided on an outer circumference of each of the stems in such a way as to be in close contact with an inner circumference of the wiper or the stem guide hole.

11. The dual type cosmetics case according to claim 9, wherein each of the stems comprises:

an O-ring, provided on an outer circumference of the stem in such a way as to be in close contact with an inner circumference of the wiper or the stem guide hole.

12. The dual type cosmetics case according to claim 1, wherein the container comprises:

a stem guide hole formed through the inlet in an extending direction of each of the stems, and guiding movement of the stems.

13. The dual type cosmetics case according to claim 1, wherein the cap comprises:

a stem positioning part provided in the cap in such a way as to protrude to a position corresponding to an inside end of each of the stems, and preventing the stem from being pushed into the cap by pressing force.

14. The dual type cosmetics case according to claim 1, wherein the plurality of stems have different materials, colors, and shapes.

15. The dual type cosmetics case according to claim 1, wherein the holder is provided in the cap and is coupled to one of the plurality of stems outside the container by rotating the cap.

16. The dual type cosmetics case according to claim 15, wherein the holder comprises a plurality of opened clips, each of the clips being fastened to an outer circumference of one of the stems by rotating the cap forwards and backwards.

17. The dual type cosmetics case according to claim 15, further comprising:

a guide part providing a guide course, and comprising:

a plurality of vertical extension parts provided on either of an outer surface of the neck of the container and an inner surface of the cap, and extending in a moving direction of the cap that detachably fastens the cap to the container, at a position where each of the stems and the holder are coupled; and a horizontal extension part that couples the plurality of vertical extension parts to each other; and a guide moving part provided on a remaining one of the outer surface of the neck of the container and the inner surface of the cap, and moving along the course guided by the vertical extension parts and the horizontal extension part of the guide part as the cap is manipulated and rotated to be detachably fastened to the container.

18. The dual type cosmetics case according to claim 1, wherein the holder comprises a plurality of opened clips, each of the clips being fastened to an outer circumference of one of the stems by rotating the cap forwards and backwards.

19. The dual type cosmetics case according to claim 1, further comprising:

a guide part providing a guide course, and comprising:

a plurality of vertical extension parts provided on either of an outer surface of the neck of the container and an inner surface of the cap, and extending in a moving direction of the cap that detachably fastens the cap to the container, at a position where each of the stems and the holder are coupled; and a horizontal extension part that couples the plurality of vertical extension parts to each other; and a guide moving part provided on a remaining one of the outer surface of the neck of the container and the inner surface of the cap, and moving along the course guided by the vertical extension parts and the horizontal extension part of the guide part as the cap is manipulated and rotated to be detachably fastened to the container.

20. The dual type cosmetics case according to claim 19, wherein the guide part provides a guide course having a shape of "⊔" or "⊔⊔".

21. The dual type cosmetics case according to claim 19, wherein the guide part is depressed, and the guide moving part protrudes to be inserted into the vertical extension parts and the horizontal extension part of the guide part.

22. A dual type cosmetics case comprising:

a container having first and second containing parts and first and second inlets divided in a vertical direction;

a cap coupled to the first and second inlets of the container;

first and second stems detachably coupled to the first and second containing parts of the container, respectively; and a holder provided in the cap, and coupled to any one of the first and second stems to be taken out of the container.

23. The dual type cosmetics case according to claim 22, wherein the container comprises:

a wiper provided in each of the first and second inlets, that wipes an outer circumference of each of the first and second stems.

24. The dual type cosmetics case according to claim 22, wherein the cap comprises a double structure having an outer cap and an inner cap, an opening prevention uneven part is provided in a lower end of an inner circumference of the inner cap, and the holder is provided at a predetermined position on an upper end of the inner circumference of the inner cap.

25. The dual type cosmetics case according to claim 22, wherein the first and second stems comprise application parts and coupling parts, the application parts being provided on ends of the stems immersed into the first and second containing parts of the container to apply cosmetic liquids, the coupling parts being provided on upper ends of the first and second stems which protrude upwards from the first and second inlets to be detachably coupled to the holder.

26. The dual type cosmetics case according to claim 22, wherein the holder comprises first and second clips, the first and second clips being provided on left and right sides of an end extending from the upper end of the inner circumference of the inner cap to a center thereof and being coupled to any one of the first and second stems.

* * * * *